United States Patent [19]

Sagel

[11] 4,439,474

[45] Mar. 27, 1984

[54] DISPOSABLE FLOOR MAT WITH IMPROVED WET SOIL ABSORPTIVITY

[75] Inventor: Paul J. Sagel, Cincinnati, Ohio

[73] Assignee: The Procter & Gamble Company, Cincinnati, Ohio

[21] Appl. No.: 316,477

[22] Filed: Oct. 30, 1981

[51] Int. Cl.[3] ..... B32B 33/00

[52] U.S. Cl. ..... 428/90; 428/95; 428/96; 428/97

[58] Field of Search ..... 428/95, 96, 97, 90

[56] References Cited

U.S. PATENT DOCUMENTS

| | | | |
|---|---|---|---|
| 2,251,372 | 8/1941 | Nicholson | 154/49 |
| 2,826,778 | 3/1958 | Highlen | 15/215 |
| 3,141,522 | 7/1964 | Fitzpatrick | 184/106 |
| 3,159,502 | 12/1964 | Menin | 117/121 |
| 3,517,407 | 6/1970 | Wyant | 15/215 |
| 3,696,459 | 10/1972 | Kucera et al. | 15/104.92 |
| 3,856,610 | 12/1974 | Bruneel | 161/43 |
| 3,961,117 | 6/1976 | Kydonieus et al. | 428/96 |
| 4,107,055 | 8/1978 | Sukornick et al. | 252/8.6 |

FOREIGN PATENT DOCUMENTS

| | | |
|---|---|---|
| 1155552 | 6/1969 | United Kingdom . |
| 2019251 | 4/1979 | United Kingdom . |

*Primary Examiner*—Marion McCamish

*Attorney, Agent, or Firm*—Richard C. Witte; Ronald L. Hemingway; Leonard Williamson

[57] ABSTRACT

Disclosed is a disposable floor mat with improved wet soil absorbency comprising a primary backing and flocked or tufted fibers, the bases of which are adhesively or mechanically attached to said backing. The mat is characterized in that it has a surfactant disposed thereon which improves the wet soil absorbency in the mat with limited (controlled) surfactant mobility. The controlled surfactant mobility minimizes the transfer (tracking) of the disposed surfactant onto the permanent floorings.

12 Claims, No Drawings

DISPOSABLE FLOOR MAT WITH IMPROVED WET SOIL ABSORPTIVITY

BACKGROUND ART

The present invention relates to a fibrous floor mat or carpet treated with a surfactant.

In general, both the consumers and flooring manufacturers are concerned with the negative impact of soiling on the appearance of floors and carpets. Carpet manufacturers take many steps to minimize the detractive appearance of soils on carpets through careful selection of fibers, soil release finishes, and colors to either make soils easy to remove or hide their presence. Consumers also employ means to minimize the effects of soiling on their floors and carpets by frequent vacuuming and sweeping to retrieve soils. Another means for preserving floor appearance is to trap soils before they are transferred via foot traffic onto permanent floors and carpets. Often this is done with the use of floor mats. To be more useful, floor mats need to trap both wet and dry soils effectively.

Floor mats with an assembled fibrous top surface are highly effective for removing dry soils from the bottom of a shoe. Wet soils also need to be absorbed by these flocked mats. However, the contact time during which this absorption takes place is often very short. Using a normal walking pace of about 100–120 steps per minute, this contact time is about 0.5 second. In this case, it is desirable that these floor mats have quick absorption rates such that wet soils can be absorbed from the bottom of a person's shoes during this short 0.5 second residence time.

It can be easily shown that the presence of a surfactant on a fibrous floor mat will improve its rate of absorption of wet soils. However, these more absorptive mats can cause more severe soiling of surrounding carpets when this surfactant is transferred to surrounding carpets via wet foot traffic. As pointed out by W. A. Kirn in "Mechanism and Inhibition of Carpet Resoiling," published in *Soap/Cosmetics/Chemical Specialties,* Vol. 56 (1980), pp. 38–44, sticky surfactant residues on permanent carpets will increase their rate of soiling.

Cleaning and antisoiling compositions for treating fibrous floor mats to improve the appearance and inhibit the deterioration of the appearance thereof, or to combine the cleaning and antisoiling compositions for treating fibrous carpet and floor mats, per se, are old in the art. It has been proposed in British Patent Specification No. 1,155,552, published June 18, 1969, to provide a cleaning and antisoiling composition comprising a compound represented by the formula:

$$ROSO_3M$$

wherein R is an aliphatic hydrocarbon group and M is an alkyl metal, a second constituent represented by the formula:

$$R^1CON(CH_3)CH_2COOA$$

wherein $R^1$ is an aliphatic hydrocarbon group and A is either a hydrogen atom or an alkali metal and water.

It is recognized that wetting agents increase the penetration of liquid soils into fibrous carpets treated with same. U.S. Pat. No. 4,107,055, Sukornick et al, issued Aug. 15, 1978, discloses at Col. 13 that fluoroalkyl surfactants are known "powerful wetting agents and would be expected to promote the penetration of soils, particularly liquid soils into substrates such as nylon carpet . . . " Also Table IV of the Sukornick et al. patent teaches the use of a number of other surfactants in "dry soil resistance" compositions for carpets. There are numerous other references which teach surfactants in dry soil resistance compositions for carpets, e.g., U.S. Pat. No. 3,961,117, Kydonieus et al., issued June 1, 1976.

It is an object of the present invention to provide a highly absorbent, disposable, surfactant treated floor mat primarily for keeping wet soils off the main carpet.

Another object is to provide such a surfactant treated mat with controlled, minimal surfactant mobility.

Yet another object is to provide test methods to identify surfactant treated fibrous mats which have both improved wet soil absorbency and controlled, minimal surfactant mobility.

Still another object of this present invention is to teach a means for using surfactants on floor mats that will improve absorbency without the deleterious transfer of surfactants onto surrounding floors and carpets.

SUMMARY OF THE INVENTION

A fibrous floor mat comprising: a primary mat backing and assembled fibers, the bases of which are attached or locked to said primary backing; the fibrous mat is characterized in that a controlled amount of surfactant is disposed thereon. The mat has minimal surfactant mobility as indicated by a contact angle value of 75° to 86° as determined by the Surfactant Mobility Test. The characterized mat has significantly improved wet soil absorbency as determined by the Wet Soil Absorbency Test.

DETAILED DESCRIPTION OF THE INVENTION

This invention relates to a fibrous floor mat with selected and controlled surfactant disposed thereon to increase the wet soil absorbency without significant surfactant mobility.

Accordingly, the present invention provides selected flocked or tufted fibers attached to a compatible primary backing. These attached fibers are known in the art as "face fibers." "Face fiber density" is the weight of the face fibers per unit area. Face fiber densities for flocked and tufted substrates are provided by the manufacturers. Face fiber densities can normally be obtained from the fibrous mat material suppliers. If this information is not available, the face fiber density can be determined as follows: (A) determine the weight $W_i$ and the surface area A of a fibrous mat sample of at least 5 cm×5 cm in size; (B) remove all the fibers from the backing surface with a razor blade, e.g., an X-ACTO® knife; (C) determine the weight $W_f$ of the shaved backing; (D) face fiber density is $(W_i - W_f)/A$.

The fibers alone, or the fibers and the backing are treated with a controlled amount of a selected fiber-substantive surfactant. The selective surfactant treatment improves the water absorbency of the mat. The selective surfactant treatment of the mat renders the surfactant "fiber-substantive" so that an insignificant (minimal) amount of surfactant will track off the mat onto the main flooring. The mat has minimal surfactant mobility as indicated by a contact angle value of 75° to 86° as determined by the Surfactant Mobility Test. Preferably the contact angle value is 77° to 85°, and most preferably 79° to 85°. Thus, provided is a superior disposable floor mat for household use. The target areas of the house include the entrances, the kitchen and bathroom.

Flocked and Tufted Fibrous Mat Starting Material

Methods for making nonsurfactant treated or uncontrolled surfactant treated flocked or tufted fibrous mats, useful as starting material for the present invention, are well known in the art.

Fibrous mat starting material comprising flocked or tufted fibers attached to a primary backing are commercially available. The fibers can be natural or synthetic. The backing can be a conventional woven substrate or a nonwoven fibrous sheet, a suitable plastic film, a polymeric foam, etc. The fibers can be adhesively or mechanically attached to the primary backing. Such materials are well known and disclosed in the literature. Special attention is directed to the references set out in *Flocked Materials Technology and Applications,* 1972, by E. L. Barden, published by Noyes Data Corporation; and *AATCC Flock Handbook,* R. G. Weyker, Editor, published by the American Association of Textile Chemists and Colorists, 1972; both incorporated herein by reference.

A PREFERRED EMBODIMENT

A preferred disposable floor mat is an attractive mat made of durable nylon flock adhesively attached to a nonwoven polyester primary backing. Nylon fibers provide better durability and improved appearance than natural fibers but without selected surfactant treatment, nylon gives poor wet soil absorbency. However, without controlled surfactant treatment the above-mentioned surfactant mobility problem can occur. Preferred selected surfactant treatment of the flocked nylon mat is provided by soaking the mat in a sufficient amount of a surfactant solution, e.g., one containing linear alkyl benzene sulfonate (LAS). An illustration of a preferred selected surfactant treatment operation includes soaking the fibrous mat starting material in a 30–50 ppm LAS surfactant solution at a surfactant to fabric weight ratio percent of 0.3 to 0.5, then rinsing the soaked mat in clear water to assure that no excess surfactant remains on the mat. Such a selectively treated flocked nylon floor mat has improved mat wet soil absorbency with controlled minimal surfactant mobility.

It is critical that the mat of this invention has limited surfactant mobility as indicated by a contact angle value of 75° to 86° as determined by the Surfactant Mobility Test. It is also critical that the surfactant treated mat has improved wet soil absorbency.

Surfactant Mobility Test

This test method is used to evaluate the degree of mobility of the surfactant on a treated fibrous mat. Surfactant mobility is indirectly determined by the surface activity of liquid extracted from a wetted mat. The surface activity is determined by measuring the contact angle of a sessile drop of the extracted liquid.

Steps Used to Measure the Contact Angle

1. The water contact angle is measured on a Rame-Hart Contact Angle Goniometer, Model A-100.
2. The substrate used for the contact angle measurement is a flat piece of polystyrene which is cut from a polystyrene Petri dish (Fisher Brand, Catalog No. 8-757-13).
3. The contact angle of distilled water is first determined by depositing a drop on the polystyrene surface. The drop is about 0.005 ml of the distilled water and is deposited using a 0.1 ml Microliter® #710 microsyringe, U.S. Pat. No. 2,933,087, Hamilton Co., Reno, Nev. The contact angle is measured 30 seconds after the drop is deposited on the polystyrene substrate. Four replicates are obtained and the mean value is calculated. Distilled water has a contact angle of about 86°.
4. The mat sample to be tested shall be a 2"×2" (5.1 cm×5.1 cm) square. The mat sample preferably consists only of the face fibers attached to a primary backing. The face fibers are evenly wetted with distilled water at a water/face fiber weight ratio of 14.0/1 to 14.3/1, preferably 14.1/1 to 14.2/1. Care should be taken to avoid spilling of the water from the face fiber area. Illustration: A 5.1 cm×5.1 cm square flocked nylon fibrous mat sample, having a face fiber density of 6.78 mg/cm$^2$ and a total mat basis weight of 20.6 mg/cm$^2$ is placed in a polystyrene Petri dish. The total face fiber weight is about 176 mg. Distilled water at a water/face fiber weight ratio of 14.2/1 (2.5 ml) is delivered onto the face fibers of the sample in about 15 seconds using a 2.5 ml Gastight® syringe #1002, Hamilton Co., Reno, Nev.
5. The water is allowed to soak for 1 minute on a horizontal surface and then at least about 0.030 ml of liquid is extracted from the top of the mat square with a 0.1 ml microsyringe.
6. The contact angle of the extracted liquid is determined in the same manner as described in Step 3.

The surfactant mobility of a surfactant-treated fibrous mat is unacceptably excessive if the contact angle is less than 75°. The surfactant mobility is controlled when the surfactant treated fibrous mat has a contact angle of from about 75° to about 86° according to the Surfactant Mobility Test as described above.

In addition to minimal controlled surfactant mobility, the mat of this invention has improved wet soil absorbency over an untreated mat.

Wet Soil Absorbency Test

The following test method is used to compare the wet soil absorption performance of a surfactant-treated floor mat with that of an untreated floor mat. The test objective is to visually grade the amounts of dyed water tracked by a shoe onto white floor tiles after stepping on the treated and untreated mats.

Steps Used to Measure Wet Soil Absorbency

1. The white floor tiles used are 1 square foot Kentile Reinforced Vinyl Asbestos Tiles, 514M White Beaux Arts Series (Kentile Floors, Inc., Chicago, Ill. 60632). The tiles are precleaned by wiping with an isopropanol impregnated paper towel.
2. About 250 ml of a 0.02% aqueous FD&C Red #4 dye solution is poured onto two layers of 41 cm×25 cm×0.5 cm nonwoven polyester substrate (A-1200 White, Hi-loft, 6.78 mg/cm$^2$, obtained from the New Milford Nonwoven Corp., New York, N.Y. 10017) that are placed in the bottom of a 63 cm×46 cm×2.5 cm plastic pan.
3. The plastic pan containing the dye solution, the test mat sample and a white floor tile are respectively positioned in a straight line one walking stride apart.
4. The tester uses a flat shoe to which a Goodyear Chemigum® shoe sole is trimmed to fit this shoe in such a manner that the smooth side of the Chemigum ® sole is left exposed. The sole is appended to the shoe with double-face carpet tape. (Sears, Roebuck and Co., Chicago, Ill. 60684)

5. The tester steps the shoe into the plastic pan containing the dye solution, then onto the mat, and finally onto the floor tile, using normal downward walking pressure and stride (100–120 strides/minute). Unabsorbed dye water on the shoe sole after stepping on the mat will make an imprint on the white floor tile. The wet soil absorption of the mat is tested.
6. Step 5 is repeated until four replicates are obtained for a surfactant treated mat sample and four replicates are obtained for a corresponding untreated mat sample.
7. The tiles are allowed to dry in place then are randomly paired up into four pairs. Each pair of tiles contains a tile corresponding to a treated mat and one tile corresponding to the untreated mat.
8. Three judges compare the dye traces on the two tiles of each pair, using the −4 to 4 grading scale (0: equal; 1: I *think* this one may be better; 2: I *know* this one is better; 3: This one is a *lot* better; 4: This one is a *whole lot* better; −1: I *think* this one may be worse; −2: I *know* this one is worse; −3: This one is a *lot* worse; −4: This one is a *whole lot* worse).
9. The twelve grades are analyzed by the standard analysis of variance. The treated and untreated samples have significantly different water absorption performance when the corresponding t-test probability is less than or equal to 0.05 (representing a 95% confidence level or higher). The above test is used to determine the wet soil absorbency performance of a surfactant treated mat vs. an untreated mat. A treated mat has improved wet soil absorbency performance if there is significantly less visual dye residue on the corresponding test tiles.

It will be shown below that wet soil absorbency performance can depend not only on the fiber and the chemical properties of the surfactant used, but also on the method of surfactant treatment. For example, one method of treatment is a soak/rinse method, another is a surfactant solution spray-on application. The surfactant can also be applied to the fibers before or after attachment to the primary backing. Water hardness also is a factor to consider, e.g., in some cases the surfactant treatment yields better performance if soft or distilled water is used. See Examples 1 and 2.

Accordingly, the present invention is thus based on a mat which passes the above two tests, namely, the Wet Soil Absorbency Test and the Surfactant Mobility Test. The Wet Soil Absorbency Test consists of a visual comparison of the amount of dye water residue that is tracked onto a white tile by a specified shoe sole after stepping onto a mat and then onto the white floor tile. The surfactant treated mat is superior in wet soil absorbency performance if its corresponding tile has significantly less dye residue than that of a corresponding untreated mat. The Surfactant Mobility Test determines the degree of decreased surface tension of water on a wetted mat attributable to the added surfactant. Surfactant mobility is acceptably low if the water contact angle measurement of liquid extracted from a treated mat is between 75° and 86°. The larger the contact angle, the lower the degree of surfactant mobility. The lower the degree of surfactant mobility, the lower the amount of surfactant track off and therefore a correspondingly better floor mat with respect to surfactant transfer to the main floorings.

Floor mats of this invention belong to Category I as set out in Table I. Categories II-IV are provided to distinguish the present mat from inferior floor mats.

TABLE I

| Performance Categories | Absorbency[1] | Surfactant Mobility[2] |
|---|---|---|
| Untreated | Basis | Basis |
| I | + | + |
| II | − | + |
| III | + | − |
| IV | − | − |

[1]The "+" means better than basis; the "−" worse than basis.
[2]The "+" means acceptably low surfactant mobility; the "−" unacceptably high surfactant mobility.

Only mats in Category I are within the scope of this invention; i.e., have improved wet soil absorbency, as well as a contact angle of 75° to 86° which translates into limited surfactant transfer.

The flocked mats used in Examples 1–14 comprised flocked nylon fibers, the bases of which were adhesively bonded to a primary mat backing of a nonwoven polyester.

The mats were comprised of: NI07-50475-C Blue, 2 oz. of nylon fiber per sq. yd. adhesively bonded to a nonwoven sheet of polyester Confil ® Stock 1120F, 2 oz. per sq. yd. basis weight. Such mats all have a face fiber density of 6.78 mg/cm$^2$. The total density of NI07 Blue, including the primary backing sheet of polyester and the adhesive, is approximately 20.58 mg/cm$^2$.

EXAMPLE 1

Surfactant Application

Eight pieces of blue flocked sheet (NI07-50475-C Blue, from Vertipile, Inc., Leominster, Mass. 01453) of dimension 23"×35" (58 cm×89 cm) are put in a clothes washer (an immersion bath) containing 8.7 grams of Aerosol TR-70, 70% active (American Cyanamid, Wayne, N.J. 07470) and 64.4 liters of soft water at 27° C. The washer content is agitated gently for 8 minutes, then the surfactant solution is spun out. The flocked mat is then rinsed with 64.4 liters of soft water (agitated for 2 minutes then spun out) to remove excess of surfactant. The flock mat is then dried in an automatic hot air clothes dryer at 85° C. The surfactant treated mat is then tested as specified in the Wet Soil Absorbency Test and the Surfactant Mobility Test.

Wet Soil Absorbency Test for Example 1

The wet soil absorbency test gave absorption grade of 2.17 with a standard deviation of 0.58 which showed by analysis of variance that the treated mat had superior wet soil absorbency performance over the untreated mat. The t-test probability was 0.001 representing a 99.9% confidence level.

Surfactant Mobility Test of Example 1

The Surfactant Mobility Test gave water contact angle of 81.4° which evidences controlled low surfactant mobility.

These data show that the above mat and the method of making it are within the scope of the present invention.

EXAMPLE 2

Example 1 was repeated in every respect except that 12 grain hardness water was used instead of soft water.

The Wet Soil Absorbency Test gave absorption grade of 0.50 with a standard deviation of 1.27 which, by the analysis of variance, showed that the performance of the treated material is *not* significantly different than that of the untreated material at 95% confidence level.

The Surfactant Mobility Test contact angle was 73.4° which indicates unacceptably high surfactant mobility for the mat of the present invention.

It will be noted that Examples 1 and 2 use identical surfactant at the same level with the only difference being the use of hard water (12 grain) in the application. Hence, this surfactant falls within the scope of this invention when applied from a soft water immersion bath, but not a hard water immersion bath.

Table II shows Examples 1–14. The treatment procedure and the testing, etc., set out in Example 1 were followed in every respect except as indicated in Table II. The surfactant/face fiber weight percent ratios of Examples 1–14 are obtained by multiplying the respective surfactant/fibrous mat weight ratio percent by 3.0354.

TABLE II

| Example No. | Surfactant | Surfactant/ Fibrous Mat Wt. Ratio (%) | Performance Category |
|---|---|---|---|
| 1 | Aerosol TR-70[a] | .717* | I |
| 2 | Aerosol TR-70[a] | .717 | IV |
| 3 | LAS[b] | .335* | I |
| 4 | LAS[b] | .335 | I |
| 5 | Commercial CHEER ® detergent containing 16.8% LAS[b] and 0.5% $CnAE_6$[c] | .387 | I |
| 6 | Gafac GB-520[d] | .357* | I |
| 7 | Gafac GB-520[d] | .357 | I |
| 8 | Alipal CO-433[e] | .359 | I |
| 9 | Alipal CO-433[e]** | 1.703 | III |
| 10 | Calamide C[f] | .378 | I |
| 11 | Calamide C[f]** | 1.730 | I |
| 12 | Span 40[g] | .378 | I |
| 13 | DTDMAC[h] | .374 | II |
| 14 | Triton RW-50[i] | .374 | II |

[a]Bis(tridecyl) ester of sodium sulfo-succinic acid (American Cyanamid, Wayne, New Jersey)
[b]Sodium $C_{13}$—linear alkylbenzene sulfonate (The Procter & Gamble Co., Cincinnati, Ohio)
[c]Coconut alcohol ethoxylated (6)
[d]Organic phosphate ester partial sodium salt (GAF Corp., New York, New York)
[e]Sodium salt of sulfated nonylphenoxy-poly(ethyleneoxy)ethanol (GAF Corp., New York, New York)
[f]$C_{12-18}$ alkyldiethanolamide (Pilot Chemical Co., Santa Fe Springs, California)
[g]Sorbitan monopalmitate (ICI Americas, Inc., Wilmington, Delaware)
[h]Ditallowdimethylammonium chloride (Sherex, Mapleton, Illinois)
[i]$C_{12-14}$ alkylethoxylated(5) amine (Rohm and Haas Co., Philadelphia, Pennsylvania)
*Soft water was used in the surfactant treatment. All other treatments used 12 grain water.
**Three pieces of blue flock sheet of dimension 15" × 15" (38.1 cm × 38.1 cm) were used instead of eight 23" × 35" pieces.

EXAMPLE 15

Two pieces of rayon velvet (tufted) (Lucia ® 7954, Heaven Blue 2655, 6.4 oz. per sq. yd. [21.70 mg/cm²] from T. B. Martin Co., New York, N.Y. 10019) of dimension 65 cm×99 cm are treated in the same procedure as in Example 2 (hard water) except that the surfactant used was 9.5 grams of sodium $C_{13}$-linear alkyl benzene sulfonate (30% active, from The Procter & Gamble Co., Cincinnati, Ohio). The surfactant/fibrous mat weight ratio percent is 1.02. The surfactant/face fiber weight ratio is 0.036/1.

Wet Soil Absorbency Test for Example 15

The Wet Soil Absorbency Test gave absorption grade of 3.19 with a standard deviation of 0.29 which showed by the analysis of variance that the treated mat has a significantly superior performance over the untreated mat.

Surfactant Mobility Test for Example 15

Surface fiber density of the velvet used is 6.15 mg/cm² as determined by removing the fibers from the substrate with an X-ACTO ® knife. The face fiber density was determined as follows: (A) The weight $W_i$=0.46 gm and the surface area A=26.01 cm²; (B) All the fibers were removed from the backing surface with an X-ACTO ® knife; (C) $W_f$=0.30 gm; (D) Face fiber density is $(W_i-W_f)/A$ which is 6.15 mg/cm². The amount of distilled water used to wet a 5.1 cm×5.1 cm treated velvet sample was 2.25 ml (water to fiber weight ratio was 14:1). The Surfactant Mobility Test yielded a contact angle value of 84.8°. These data show that the treated mat and the method of making it in this Example 15 are within the scope of the present invention.

EXAMPLE 16

In this example, 3 denier, 1 mm blue nylon fibers were electrostatically flocked (using a direct current flocker) and adhesively bound to a polyester nonwoven primary backing. The blue nylon is 3 denier, precision-cut 1 mm flock style #8133, lot #2465 from Cellusuede, Inc., Rockford, Ill. 61105. The nonwoven primary backing is a white polyester Confil ® 1120F, 8.9 mg/cm² basis weight, obtained from International Paper Company, Formed Fabrics Division, Lewisburg, Pa. 17837. The adhesive mixture is a blend of: 86.8 parts of Rhoplex ® E-821 resin obtained from the Rohm and Haas Company, Philadelphia, Pa.; 0.3 parts of Nopco Foamaster DF160L defoamer obtained from Diamond Shamrock Corporation, Morristown, N.J. 07960; 8.0 parts of a 50% aqueous mixture of Acrysol ASE-60 thickener obtained from Rohm and Haas Company; 1.7 parts of a 25% aqueous solution of ammonium nitrate crosslinking catalyst obtained from Fisher Scientific Company, Pittsburgh, Pa.; 1.9 parts of Aerotex 3030 modified melamine resin obtained from American Cyanamid Company, Wayne, N.J. 07470; 0.4 parts Aerotex 4040 paratoluenesulfonic acid accelerator from American Cyanamid Company with the pH of this mixture adjusted to 8.5 with 28% ammonium hydroxide obtained from Fisher Scientific Company.

The 8.9 mg/cm² Confil ® nonwoven primary backing was cut to 33 cm×88 cm. The above adhesive mixture was evenly knife-coated onto the substrate at a rate of 11.7 mg/cm² wet weight. The adhesive coated primary backing was then hung on a vertical metal ground plate 66 cm×91 cm with the adhesive coated side exposed. The style #8133 blue nylon flock was then applied at a coverage of 17.7 mg/cm² using an "Ero-Flock" brand hand-held electrostatic flocker, obtained from the Dekor Flocking Corporation, Middletown, N.Y. 10940. This sample was dried and adhesively cured for ten minutes at 134° C. in a pizza oven. The sample was then vacuumed with a Kenmore brand household vacuum cleaner (Model 116.2694 available from Sears, Roebuck and Company, Chicago, Ill.) to remove any nonadhered flock fibers. The face fiber density after vacuuming was 12.0 mg/cm$^2$.

This mat can be surfactant treated following the procedure of Example 1.

EXAMPLE 17

Construction of a Preferred Mat

The treated flocked mat of Example 6 of dimension 58 cm×89 cm is laminated with an adhesive to a polyvinyl chloride foam substrate of the same dimension. The polyvinyl chloride foam having a density of 21.55 mg/cm$^2$, was obtained from Compo Industries, Boston, Mass. The adhesive is a blend of: 89 parts by weight of Rhoplex® HA-8 acrylic resin obtained from Rohm and Haas Company, Philadelphia, Pa.; 10 parts by weight of a 2% aqueous solution of Methocel® J5MS hydroxypropyl methylcellulose powder obtained from the Dow Chemical Company, Midland, Mich.; and 1 part by weight of a 10% aqueous solution of oxalic acid obtained from Fisher Scientific Company, Pittsburgh, Pa. The flocked mat of Example 6 is laid onto the polyvinyl chloride which was coated with 40 grams of adhesive using a paint roller. The laminated product is hung to dry for 24 hours then trimmed to make a 53 cm×84 cm mat.

The mat of this example is also within the scope of the present invention because the mat of Example 6 retains its properties.

In conclusion, the mat of this invention can have a backing selected from the group consisting of woven and nonwoven fabrics, polymeric films and polymeric foams. The preferred primary mat backing is a nonwoven fabric selected from the group consisting of acrylic, rayon, cotton, nylon, polyester and lower polyolefin materials having a basis weight of from 1 mg/cm$^2$ to 50 mg/cm$^2$, and wherein the assembled fibers are selected from the group consisting of wool, acrylic, rayon, cotton, nylon, polyester and lower polyolefin materials having a face fiber density of from 1 mg/cm$^2$ to 30 mg/cm$^2$. A more preferred backing has a basis weight of from 1 mg/cm$^2$ to 30 mg/cm$^2$, and the assembled fibers have a face fiber density of from 1 mg/cm$^2$ to 20 mg/cm$^2$.

Another preferred mat has a backing which has a basis weight of from 1 mg/cm$^2$ to 20 mg/cm$^2$, and the assembled fibers have a face fiber density of from 1 mg/cm$^2$ to 20 mg/cm$^2$.

The mat of this invention can be made of fibers selected from the group consisting of natural and synthetic fibers and mixtures thereof, which are treated with a surfactant selected from the group consisting of suitable anionic and nonionic surfactants and combinations thereof.

A particularly preferred mat comprises flocked nylon fibers, the bases of which are adhesively attached to a nonwoven fibrous polyester primary backing, having a basis weight of from 1 to 20 mg/cm$^2$, and the mat has a face fiber density of from 1 to 20 mg/cm$^2$, and wherein said mat is treated with surfactant by soaking said mat in an effective amount of a linear alkyl benzene sulfonate (LAS) aqueous solution and rinsing out any excess LAS. Another particularly preferred mat comprises a nonwoven polyester primary backing which has a basis weight of from 6.5 mg/cm$^2$ to 7.25 mg/cm$^2$, and nylon flock which has a face fiber density of from 6.5 mg/cm$^2$ to 7.25 mg/cm$^2$, and an adhesive present at a level from 6.8 mg/cm$^2$ to 7.2 mg/cm$^2$, and wherein the mat is treated with an aqueous solution containing from 30 ppm to 50 ppm of LAS and wherein the LAS/mat weight ratio percent is from 0.3 to 0.5.

What is claimed is:

1. A fibrous floor mat comprising: a primary mat backing and assembled fibers, the bases of which are attached to said primary backing; characterized in that said fibrous mat has a surfactant disposed thereon at a level of less than 0.5 surfactant/mat weight ratio percent, wherein said mat has a Surfactant Mobility Test contact angle value of from 75° to 86°, whereby a minimal amount of surfactant and wet soil would be tracked off the mat, and wherein said mat has significantly improved wet soil absorbency performance over a fibrous floor mat without any surfactant disposed thereon according to the Wet Soil Absorbency Test.

2. The invention of claim 1 wherein said contact angle value is 77° to 85°.

3. The invention of claim 1 wherein said contact angle value is 79° to 85°.

4. The invention of claim 1 wherein said backing is a substrate selected from the group consisting of woven and nonwoven fabrics, polymeric films and polymeric foams.

5. The invention of claim 1 wherein said primary mat backing is a nonwoven fabric selected from the group consisting of acrylic, rayon, cotton, nylon, polyester and lower polyolefin materials having a basis weight of from 1 mg/cm$^2$ to 50 mg/cm$^2$, and wherein said assembled fibers are selected from the group consisting of wool, acrylic, rayon, cotton, nylon, polyester and lower polyolefin materials having a face fiber density of from 1 mg/cm$^2$ to 30 mg/cm$^2$.

6. The invention of claim 4 or 5 wherein said backing has a basis weight of from 1 mg/cm$^2$ to 30 mg/cm$^2$; and wherein said assembled fibers have a face fiber density of from 1 mg/cm$^2$ to 20 mg/cm$^2$.

7. The invention of claim 4 or 5 wherein said backing has a basis weight of from 1 mg/cm$^2$ to 20 mg/cm$^2$; and wherein said assembled fibers have a face fiber density of from 1 mg/cm$^2$ to 20 mg/cm$^2$.

8. The invention of claim 1 wherein said fibers are selected from the group consisting of natural and synthetic fibers and mixtures thereof, and wherein said surfactant is selected from the group consisting of suitable anionic and nonionic surfactants and combinations thereof.

9. The invention of claim 1 wherein said mat comprises flocked nylon fibers, the bases of which are adhesively attached to a nonwoven fibrous polyester primary backing, having a basis weight of from 1 to 20 mg/cm$^2$, and said face fiber density is from 1 to 20 mg/cm$^2$, and wherein said mat was treated with surfactant by soaking said mat in an effective amount of a linear alkyl benzene sulfonate (LAS) aqueous solution and rinsing out any excess LAS with clear water.

10. The invention of claim 9 wherein the nonwoven polyester has a basis weight of from 6.5 mg/cm$^2$ to 7.25 mg/cm$^2$, and wherein said flock has a face fiber density of from 6.5 mg/cm$^2$ to 7.25 mg/cm$^2$, and wherein said adhesive is present at a level from 6.8 mg/cm$^2$ to 7.2 mg/cm$^2$, and wherein said aqueous solution contains from 30 ppm to 50 ppm of LAS and wherein the LAS/mat weight ratio percent is from 0.3 to 0.5.

11. The invention of claim 1 wherein said mat comprises assembled fibers selected from the group consisting of tufted and flocked nylon fibers.

12. The invention of claim 1 wherein said surfactant is linear alkyl benzene sulfonate (LAS).

* * * * *